US009108812B2

(12) United States Patent
Sato et al.

(10) Patent No.: US 9,108,812 B2
(45) Date of Patent: Aug. 18, 2015

(54) SHEET FEEDER CASSETTE

(71) Applicant: KONICA MINOLTA, INC., Tokyo (JP)

(72) Inventors: Ryuji Sato, Toyokawa (JP); Kuniaki Ohbayashi, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 13/665,522

(22) Filed: Oct. 31, 2012

(65) Prior Publication Data

US 2013/0106049 A1 May 2, 2013

(30) Foreign Application Priority Data

Oct. 31, 2011 (JP) ..... 2011-238133

(51) Int. Cl.
*B65H 1/04* (2006.01)
*B65H 1/26* (2006.01)
*G03G 15/00* (2006.01)

(52) U.S. Cl.
CPC ..... *B65H 1/04* (2013.01); *B65H 1/266* (2013.01); *G03G 15/6502* (2013.01); *B65H 2511/12* (2013.01); *B65H 2601/24* (2013.01); *B65H 2801/06* (2013.01)

(58) Field of Classification Search
CPC ..... B65H 1/04; B65H 1/266; B65H 2511/10; B65H 2511/12
USPC ..... 271/171, 162, 164, 145
See application file for complete search history.

(56) References Cited

U.S. PATENT DOCUMENTS 7,946,575 B2 * 5/2011 Kim et al. ..... 271/171

FOREIGN PATENT DOCUMENTS

| | | | | |
|---|---|---|---|---|
| JP | 9-86679 | | | 3/1997 |
| JP | 11-59921 | | | 3/1999 |
| JP | 11-193134 | | | 7/1999 |
| JP | 11189342 | A | * | 7/1999 |
| JP | 2000016625 | A | * | 1/2000 |
| JP | 2000-034022 | | | 2/2000 |
| JP | 2002128285 | A | * | 5/2002 |
| JP | 2002-211770 | | | 7/2002 |
| JP | 2004277030 | A | * | 10/2004 |
| JP | 2005047684 | A | * | 2/2005 |

OTHER PUBLICATIONS

Notification of Reasons for Refusal mailed Oct. 8, 2013, directed to JP Application No. 2011-238133; 5 pages.

* cited by examiner

*Primary Examiner* — Luis A Gonzalez
(74) *Attorney, Agent, or Firm* — Lucas & Mercanti, LLP

(57) ABSTRACT

A sheet feeder cassette that can be fitted in and drawn from in a direction perpendicular to a sheet feeding direction, the sheet feeder cassette having: a bottom for receiving a stack of sheets thereon; a pair of side stopper plates provided on the bottom in such a manner to be movable in a sheet-widthwise direction so as to determine a widthwise position of the stack of sheets; and at least one displacement preventive device that is located on the bottom, at a position according to a widthwise position of a loadable maximum size sheet, and that is capable of coming into contact with one of the side stopper plates, wherein when the one of the side stopper plates receives force from a stack of the maximum size sheets placed on the bottom, the displacement preventive device pushes back and supports the side stopper plate due to reaction.

8 Claims, 10 Drawing Sheets

PRIOR ART

PRIOR ART

SHEET FEEDER CASSETTE

This application is based on Japanese Patent Laid-Open Publication No. 2011-238133 filed on Oct. 31, 2011, the content of which is incorporated herein by reference.

BACKGROUND OF THE INVENTION

1. Field of the Invention

The present invention relates to a sheet feeder cassette provided with side stopper plates for defining the widthwise position of sheets of a recording medium stacked therein.

2. Description of Related Art

An image forming apparatus such as a color printer may be provided with a sheet feeder cassette that is capable of storing a large number of sheets (for example, 500 sheets) therein. The sheet feeder cassette is configured, for example, to be fitted into a sheet feeder unit of the image forming apparatus for image formation and to be drawn from the image forming apparatus for loading of sheets.

Referring to FIGS. 8, 9, 10*a* and 10*b*, the structure of a conventional sheet feeder cassette 100 is described. In each of the drawings, the arrow X shows a traveling direction or a lengthwise direction of sheets P stacked in the sheet feeder cassette 100. The arrow Y shows a fit-in direction in which the sheet feed cassette 100 is fitted into the sheet feeder unit or a widthwise direction of sheets P stacked in the sheet feeder cassette 100. The arrow Z shows the vertical direction.

The sheet feeder cassette 100 comprises a rectangular bottom 101, and a front panel 102, a right wall 103, a left wall 104 and a rear wall 105 that are arranged substantially perpendicularly to the bottom 101.

The sheet feeder cassette 100 further comprises side stopper plates 106 and 107 on the bottom 101. The side stopper plates 106 and 107 define the widthwise position of sheets P stacked on the bottom 101. In order to cope with various sheet sizes, the side stopper plates 106 and 107 are configured to be capable of sliding in the widthwise direction of the sheets P typically by the action of a rack-and-pinion mechanism.

In loading sheets in the sheet feeder cassette 100, as shown by FIG. 10*a*, a user leans a side of a stack of sheets against the right wall 103 and puts the stack of sheets on the bottom 101. If necessary, thereafter, the user moves the side stopper plates 106 and 107 by hand to define the widthwise position of the sheets P. Next, the user pushes the sheet feeder cassette 100 in the fit-in direction to fit the cassette 100 into a sheet feeder unit 200. When the cassette 100 is pushed to the rear end in the sheet feeder unit 200, as shown by FIG. 10*b*, the side stopper plate 106 receives force in the fit-in direction because the stack of sheets P tries to keep moving in the fit-in direction due to inertia. This causes a problem that the side stopper plate 106 may be displaced and/or deformed by the force.

In order to solve the problem, Japanese Patent Laid-Open Publication No. 2000-34022 teaches that a support member is provided between the rear wall and the side stopper plate. Japanese Patent Laid-Open Publication No. 2002-211770 discloses that in conjunction with a slide of the side stopper plate to a position suited for the sheet size, a fall preventive member for preventing the side stopper plate from falling moves to a position suited for the sheet size.

The standards of sheet sizes vary according to country and region. For example, in Japan, the sheet sizes typically used are based on the JIS B standard, while in the U.S., the sheet sizes typically used are based on the ANSI A-E standard. According to Japanese Patent Laid-Open Publication No. 2000-34022 and Japanese Patent Laid-Open Publication No. 2002-211770, however, it is necessary to adapt the support member and the fall preventive member to the sheet size standard typically used in the destination country.

SUMMARY OF THE INVENTION

An embodiment of the present invention provides a sheet feeder cassette that can be fitted in and drawn from in a direction perpendicular to a sheet feeding direction in which sheets of a recording medium are to be fed, the sheet feeder cassette comprising: a bottom for receiving a stack of sheets of a recording medium thereon; a pair of side stopper plates that is provided on the bottom in such a manner to be movable in a widthwise direction of the stack of sheets so as to determine a widthwise position of the stack of sheets; and at least one displacement preventive device that is located on the bottom, at a position according to a widthwise position of a loadable maximum size sheet, and that is capable of coming into contact with one of the side stopper plates, wherein when the one of the side stopper plates receives force from a stack of the maximum size sheets placed on the bottom, the displacement preventive device pushes back and supports the side stopper plate due to reaction.

BRIEF DESCRIPTION OF THE DRAWINGS

The features of the present invention will be apparent from the following description with reference to the accompanying drawings, in which.

DETAILED DESCRIPTION OF THE PREFERRED EMBODIMENTS

General Structure of Image Forming Apparatus

Figure 1:
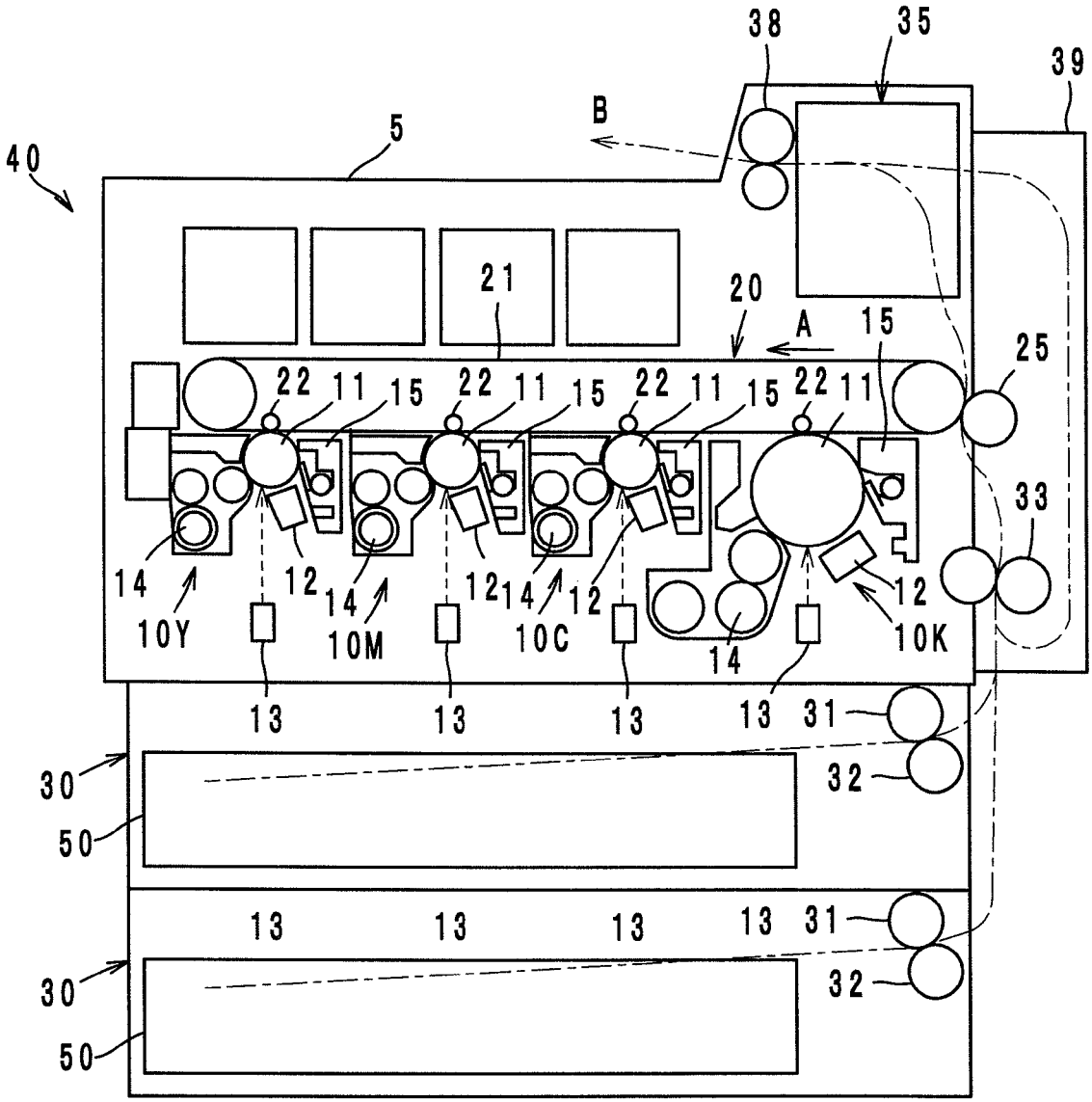
FIG. 1 is a skeleton framework of an image forming apparatus provided with a sheet feeder cassette according to an embodiment of the present invention.

First, an image forming apparatus that can be provided with a sheet feeder cassette according to a preferred embodiment of the present invention is described. As shown in FIG. 1, the image forming apparatus is, for example, a tandem-type electrophotographic color printer, and generally comprises process units 10 (10Y, 10M, 10C, 10K), an intermediate transfer unit 20, a sheet feeder unit 30 and a fixing unit 35 in a body 40. The sheet feeder unit 30 is, for example, of a two-tiered type and stores sheets of recording paper, which is an example of recording media.

Each of the process units 10 comprises a photosensitive drum 11, a charger 12, an exposure device 13, a developing device 14, a photosensitive drum cleaner 15. In each of the process units 10, an electrostatic latent image is formed on the photosensitive drum 11 with irradiation from the exposure device 13. Thereafter, the electrostatic latent image is developed into a toner image by the developing device 14.

The intermediate transfer unit 20 has an intermediate transfer belt 21, which is an endless belt driven to rotate in a direction shown by arrow A. Electric fields are formed by primary transfer rollers 22 opposed to the respective photosensitive drums 11. Thereby, toner images formed on the photosensitive drums 11 are transferred to the intermediate transfer belt 21 and are combined with each other into a full-color image (primary transfer). The electrophotographic image forming process is well known, and a detailed description thereof is omitted.

The sheet feeder unit 30, which is, for example, of a two-tiered structure, is located in a lower part of the body 40. The sheet feeder unit 30 comprises sheet feeder cassettes 50 and takes out sheets from the cassettes 50 one by one. A sheet taken out from one of the cassettes 50 is fed to a nip portion between the intermediate transfer belt 21 and a secondary transfer roller 25, where the full-color image is transferred to the sheet (secondary transfer). Thereafter, the sheet is fed to the fixing unit 35, where the sheet is subjected to a heating treatment for fixation of toner. Then, the sheet is ejected onto a tray 5 located on the upper surface of the body 40 through a pair of ejection rollers 38.

Further, a feeder unit 39 for double-side printing is provided at a side of the body 40. In a case of double-side printing, after an image is formed on a first side of a sheet, the sheet is once fed outward in a direction shown by arrow B through the pair of ejection rollers 38. Thereafter, the pair of ejection rollers 38 is rotated in reverse, whereby the sheet is fed backward (makes a switchback), and the sheet is fed back to the pair of timing rollers 33 through the feeder unit 39.

Structure of the Sheet Feeder Cassette

Figure 2:
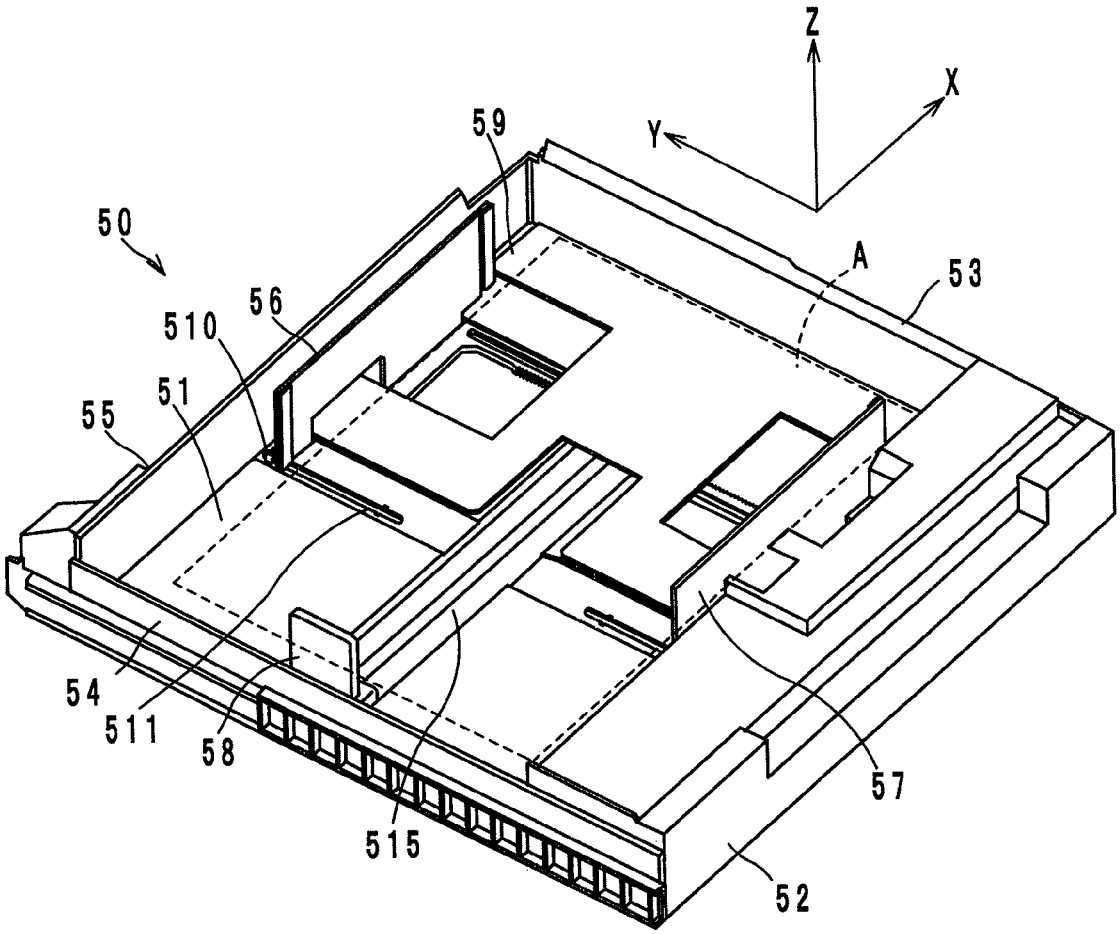
FIG. 2 is a perspective view of the sheet feeder cassette shown in FIG. 1.
Figure 3:
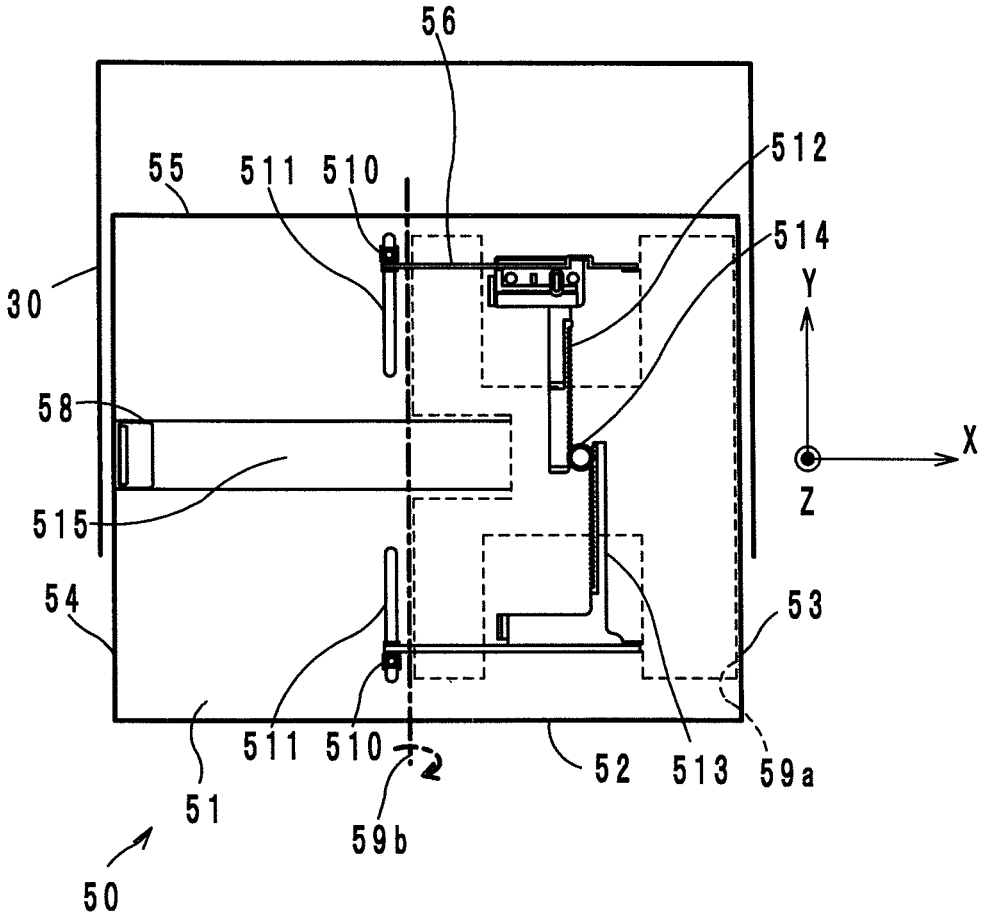
FIG. 3 is a top view of the sheet feeder cassette shown in FIG. 1.

Next, referring to FIGS. 2 and 3, the structure of the sheet feeder cassette 50 shown in FIG. 1 is described. In each of the drawings, the arrow X shows a sheet feeding direction in which sheets P of a recording medium stacked in the cassette 50 are to be fed. The arrow X also shows the lengthwise direction of the sheets P. The arrow Y shows a direction in which the cassette 50 is fitted into the sheet feeder unit 30. The arrow Y also shows the widthwise direction of the sheets P. The arrow Z shows the vertical direction. Thus, the cassette 50 is fitted into and drawn from the sheet feeder unit 30 in a direction perpendicular to the sheet feeding direction.

The cassette 50 comprises a bottom 51, and a front panel 52, a right wall 53, a left wall 54 and a rear wall 55 that are arranged substantially perpendicularly to the bottom 51.

Sheets P are stacked on the bottom 51, in a stacking area A (enclosed by dashed lines in FIG. 2). The stacking area A is large enough to receive sheets P of a large size, for example, SRA3 size (450 mm by 320 mm) at the maximum. In this embodiment, sheets P are placed and stacked in the stacking area A with one side of the stack of sheets P leant against the right wall 53. A feed roller 31 and a separation roller 32 (see FIG. 1) are located above the right wall 53, and the sheets P taken out from the cassette 50 are fed in the sheet feeding direction (shown by arrow X) one by one by these rollers 31 and 32. In this context, the side of the stack of sheets P leant against the right wall 53 will be hereinafter referred to as "a leading edge", and the side opposite thereto is referred to as "a trailing edge". Alternatively, the sheets P may be placed and stacked with one side thereof leant against the left wall 54. In this case, the leading edge of the stack of sheets P is the side leant against the left wall 54.

The cassette 50 further has, on the bottom 51, a pair of side stopper plates 56 and 57, a trailing-edge stopper plate 58, a press-up plate 59, a displacement preventive device 510 and a groove 511.

The side stopper plates 56 and 57 define the widthwise position (with respect to the direction shown by arrow Y) of a stack of sheets P in the stacking area A and prevent the sheets P from being fed askew, for example. In order to cope with various sheet sizes, the side stopper plates 56 and 57 are configured to slide in the widthwise direction of the sheets P by use of a rack-and-pinion mechanism. Specifically, rack gears 512 and 513 are fixed to the lower ends of the respective side stopper plates 56 and 57, and a pinion gear 514 is fixed on the bottom 51 in such a way to engage with the gears 512 and 513 and to be rotatable on the bottom 51. With the rack-and-pinion mechanism, when a user moves one of the side stopper plates 56 and 57 in the widthwise direction of the sheets P, the other side stopper plate 56 or 57 slides in the opposite direction.

In this embodiment, the pinion gear 514 of the rack-and-pinion mechanism is located in a downstream side of the cassette 50 with respect to the sheet feeding direction, that is, in a side near the right wall 53. One of the reasons is to improve the sheet feeding accuracy by defining the widthwise position of the stack of sheets P near the leading edge. The other reason is the positional relation to the press-up plate 59. More specifically, the position of the press-up plate 59 is determined in consideration for securement of enough torque, prevention of bends of sheet metals, etc. Thus, because the placement of the press-up plate 59 is limited, the pivot point of the side stopper plates 56 and 57 is located in a downstream side of the cassette 50 with respect to the sheet feeding direction.

The respective right ends and left ends of the side stopper plates 56 and 57 are positioned as follows. The right ends (near the leading edge of the stacked sheets P) of the side stopper plates 56 and 57 are at a specified distance from the right wall 53 so as not to inhibit the press-up plate 59 from moving. The positions of the left ends of the side stopper plates 56 and 57 are such that, when sheets P of the loadable maximum size are stacked in the cassette 50, the left ends of the side stopper plates 56 and 57 are located leftward from the center of the stacked sheets P in the lengthwise direction.

The trailing-edge stopper plate 58 defines the position of the trailing edge of the stack of sheets P. In order to cope with various sheet sizes, the trailing-edge stopper plate 58 is configured to slide in the direction shown by arrow X along a groove 515 made in the bottom 51. Further, additional grooves are formed in a direction shown by arrow Z so as to lock the trailing-edge stopper plate 58. However, these grooves are not shown in the drawings.

The press-up plate 59 is made of a sheet metal, and is located in the downstream side of the stacking area A. The right side of the press-up plate 59 is pressed by a spring (not shown) located under the press-up plate 59. By the force of the spring, the right end 59*a* of the press-up plate 59 moves in the direction shown by arrow Z by using the left end 59*b* as a substantive pivot center. In this structure, the press-up plate 59 lifts the leading edge of the stack of sheets P up to the feed roller 31 and the separation roller 32 (see FIG. 1).

Structure of the Displacement Preventive Device

Figure 4:
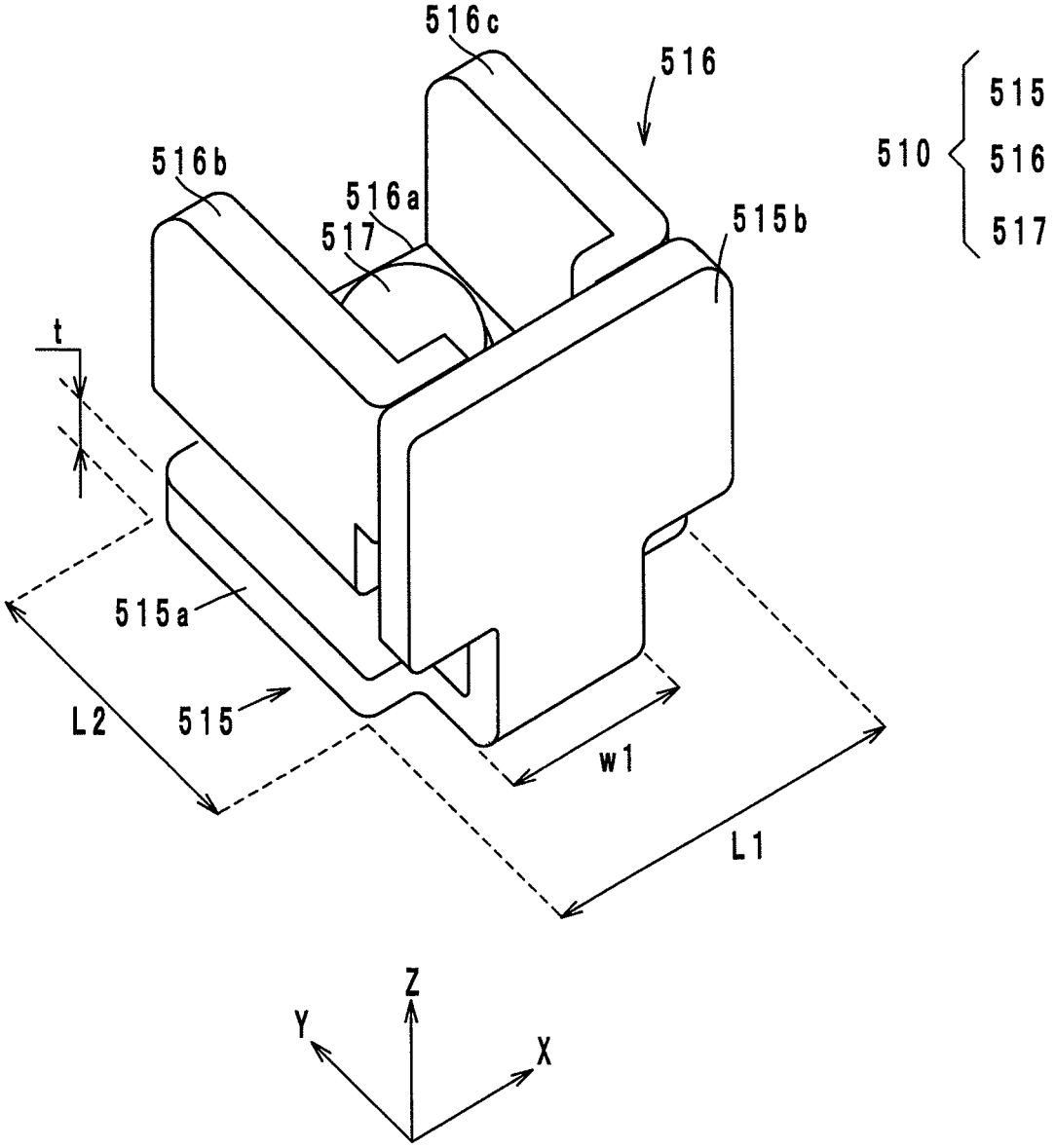
FIG. 4 is a perspective view of a displacement preventive device shown in FIG. 2.
Figure 5:
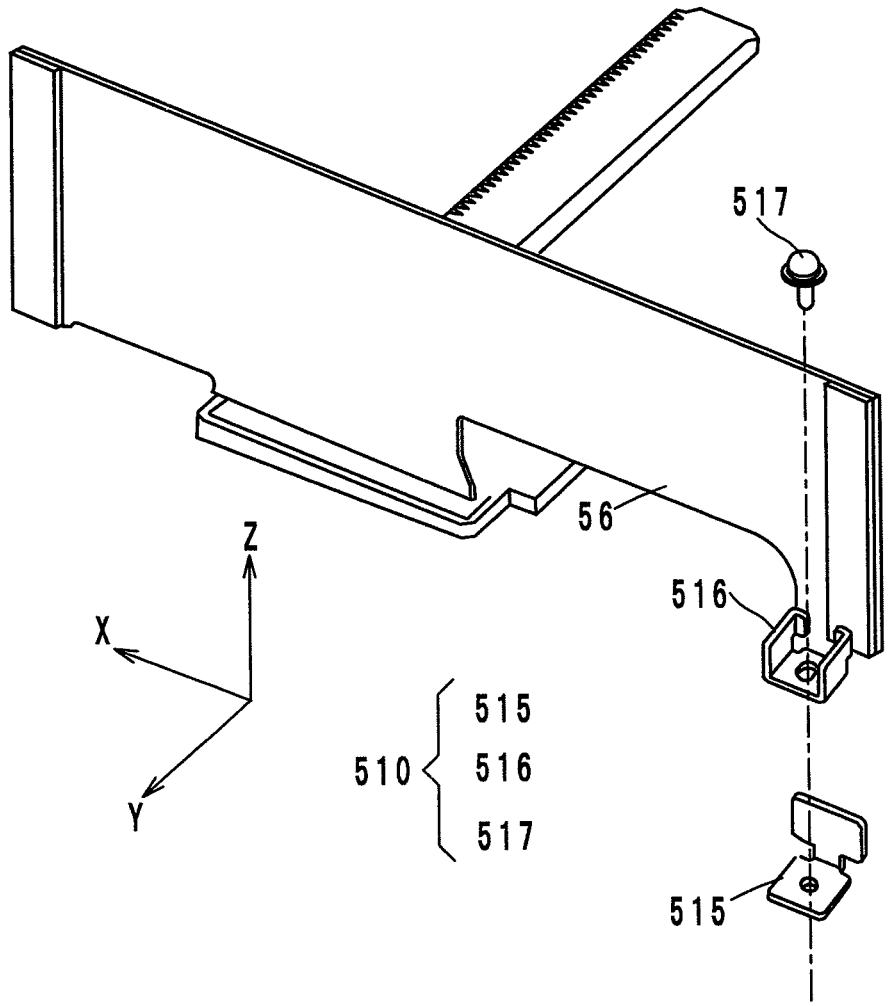
FIG. 5 is an assembly drawing of the displacement preventive device shown in FIG. 2.

Referring to FIGS. 4 and 5, the structure of the displacement preventive device 510 is described. The displacement preventive device 510 comprises a first displacement preventive member 515, a second displacement preventive member 516 and a screw 517.

The first displacement preventive member 515, which is made of, for example, a metal plate, has a base 515*a* and an abutting surface 515*b*. The base 515*a* is substantially rectangular in its top view. A screw hole in which the screw 517 is to be fitted is made in the base 515*a*. The dimensions L1 and L2, which are in the direction X and in the direction Y, respectively, and the thickness t of the base 515*a* are determined appropriately depending on the slide groove 511. The dimensions L1, L2 and t of the base 515*a* will be described in detail later. The abutting surface 515*b* is substantially rectangular in its front view and extends substantially perpendicularly to the base 515*a*. A connection between the base 515*a* and the abutting surface 515*b* has a width w1 in the direction X. The width w1 is determined appropriately depending on the slide groove 511. The width w1 will be described in detail later.

The second displacement preventive member 516 is made of, for example, a metal plate. The second displacement preventive member 516 has a pressing surface 516*a* that is substantially rectangular in its top view. A screw hole in which the screw 517 is to be fitted is made in the pressing surface 516*a*. It is preferred that supporting portions 516*b* and 516*c* are provided on the pressing surface 516*a* such that the supporting portions 516*b* and 516*c* can support the abutting surface 515*b* from the rear when the displacement preventive device 510 is assembled.

Figure 6:
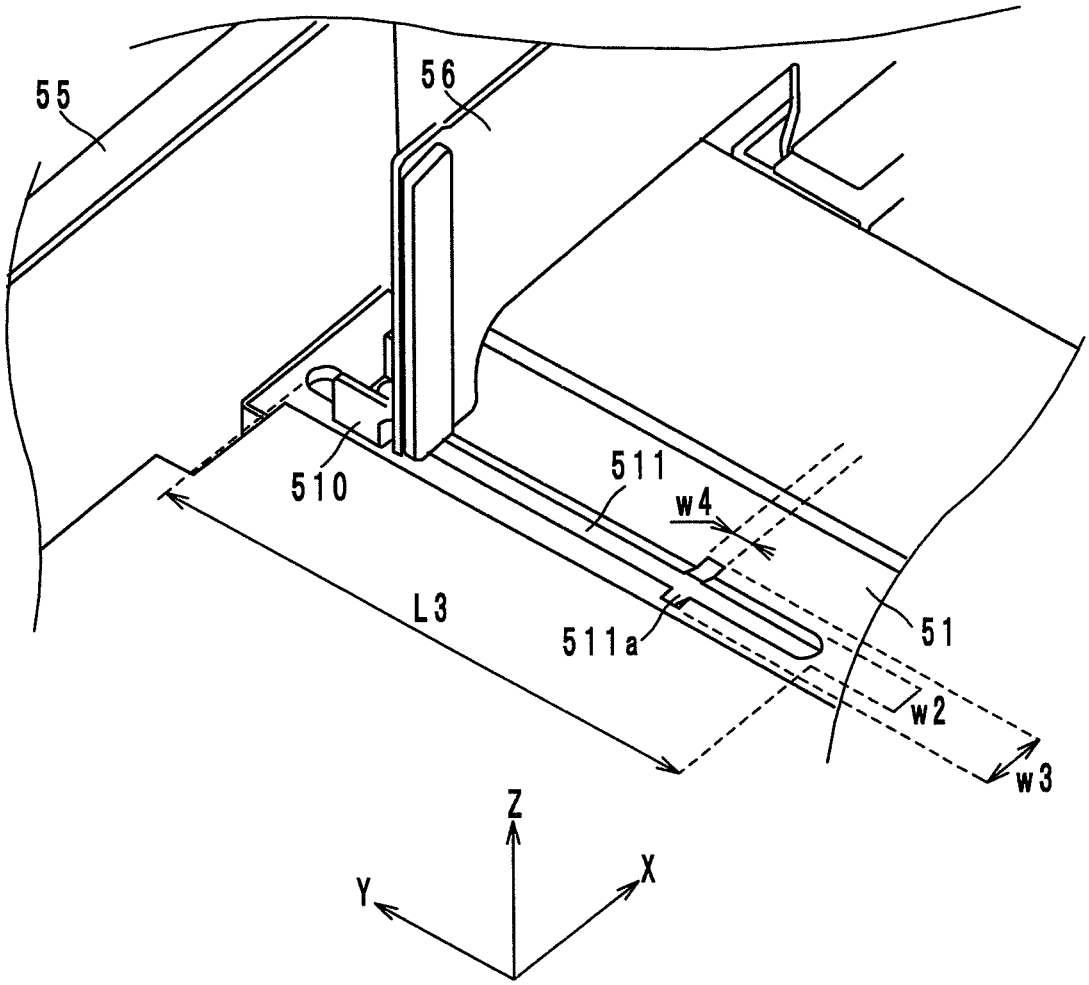
FIG. 6 is a perspective view of a slide groove shown in FIG. 2 and its periphery.

Next, reference is made to FIG. 6. The slide groove 511 is made in a metal plate constituting the bottom 51. Specifically, the slide groove 511 is formed to extend in the direction Y immediately under the left end of the side stopper plate 56 (i.e., upstream in the sheet path in the sheet feeder cassette 50). The slide groove 511 has a length L3 that is long enough to cover the sliding range of the side stopper plate 56. The slide groove 511 has a width w2 that is a little greater than the width w1. In the middle of the slide groove 511, an inlet 511*a* for receiving the displacement preventive device 510 is formed. The dimension w3 of the inlet 511*a* in the direction X is a little greater than the length L1 of the base 515*a*, and the dimension w4 of the inlet 511*a* in the direction Y is a little greater than the thickness t of the base 515*a*.

Next, fitting of the displacement preventive device 510 is described. The first displacement preventive member 515 is inserted into the inlet 511*a* made in the slide groove 511 with the second displacement preventive member 516 loosely fitted thereto via the screw 517. Then, while the both sides of the slide groove 511 are nipped between the base 515*a* and the pressing surface 516*a*, the displacement preventive device 510 is moved along the slide groove 511 to the neighborhood of the rear wall 55. Thereafter, the abutting surface 515*b* is positioned in accordance with a specified sheet size, and the displacement preventive device 510 is fixed thereat by tightening the screw 517. The specified sheet size is preferably the maximum sheet size according to a sheet size standard used in a country or region to which the image forming apparatus shown in FIG. 1 is to be shipped. For example, if the image forming apparatus is to be used in Japan, the specified sheet size is SRA3. After the displacement preventive device 510 is fixed in this way, the side stopper plate 56 is fitted onto the bottom 51.

Effect of the Displacement Preventive Device

Figure 7A:
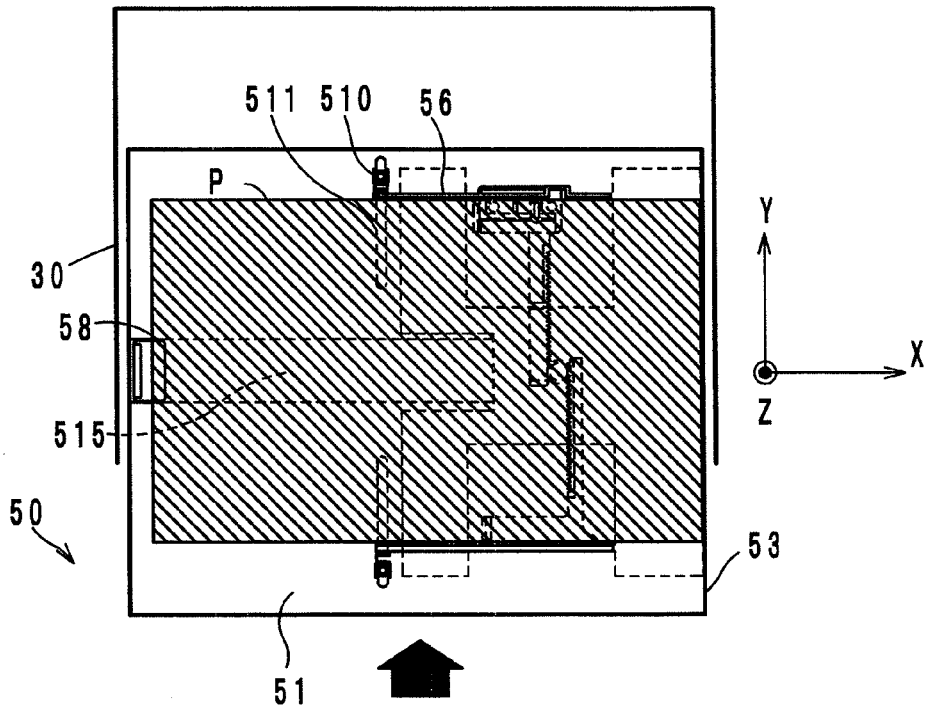
FIGS. 7*a* and 7*b* are illustrations showing the function and the effect of the displacement preventive device.
Figure 7B:
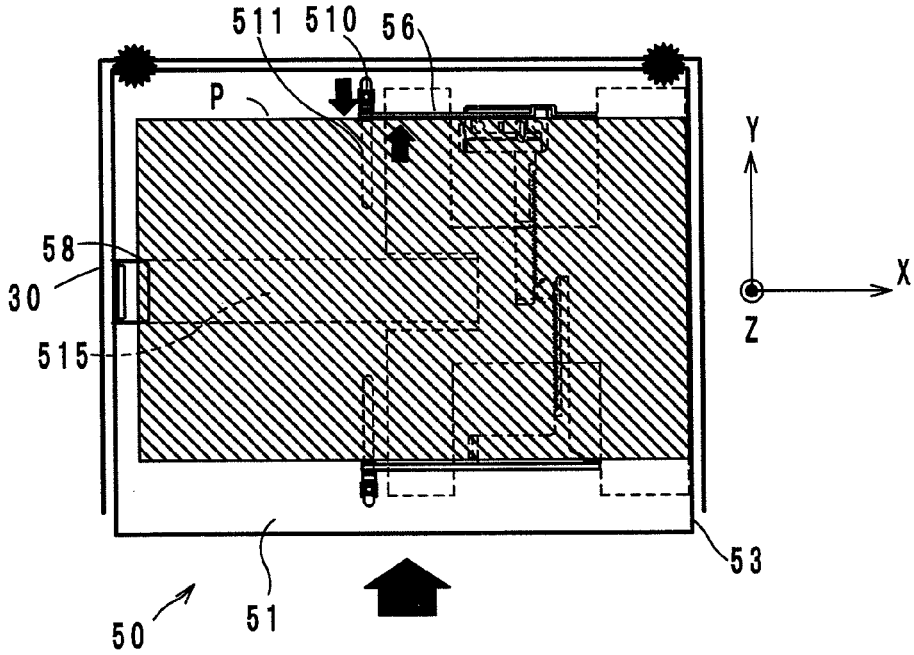
Figure 8:
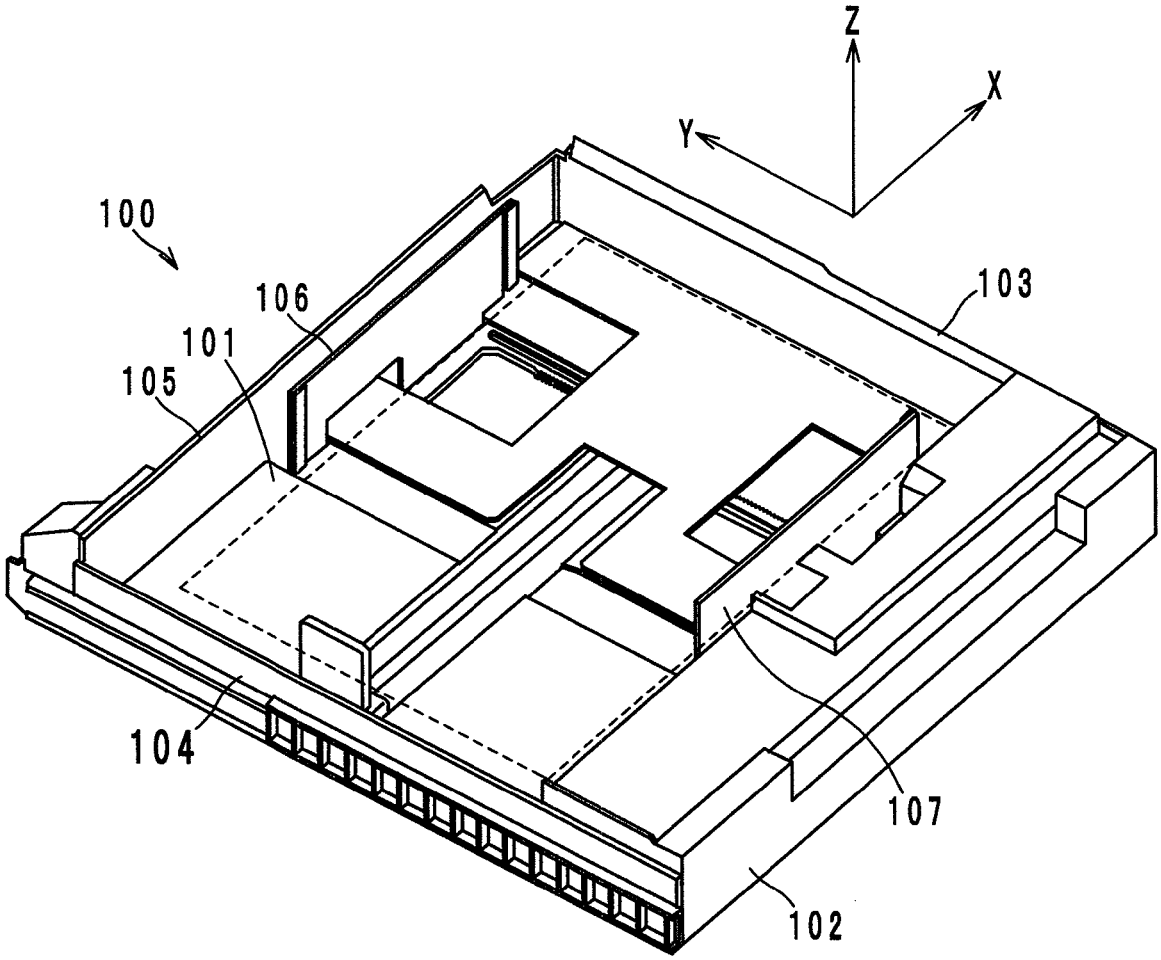
FIG. 8 is a perspective view of a conventional sheet feeder cassette.
Figure 9:
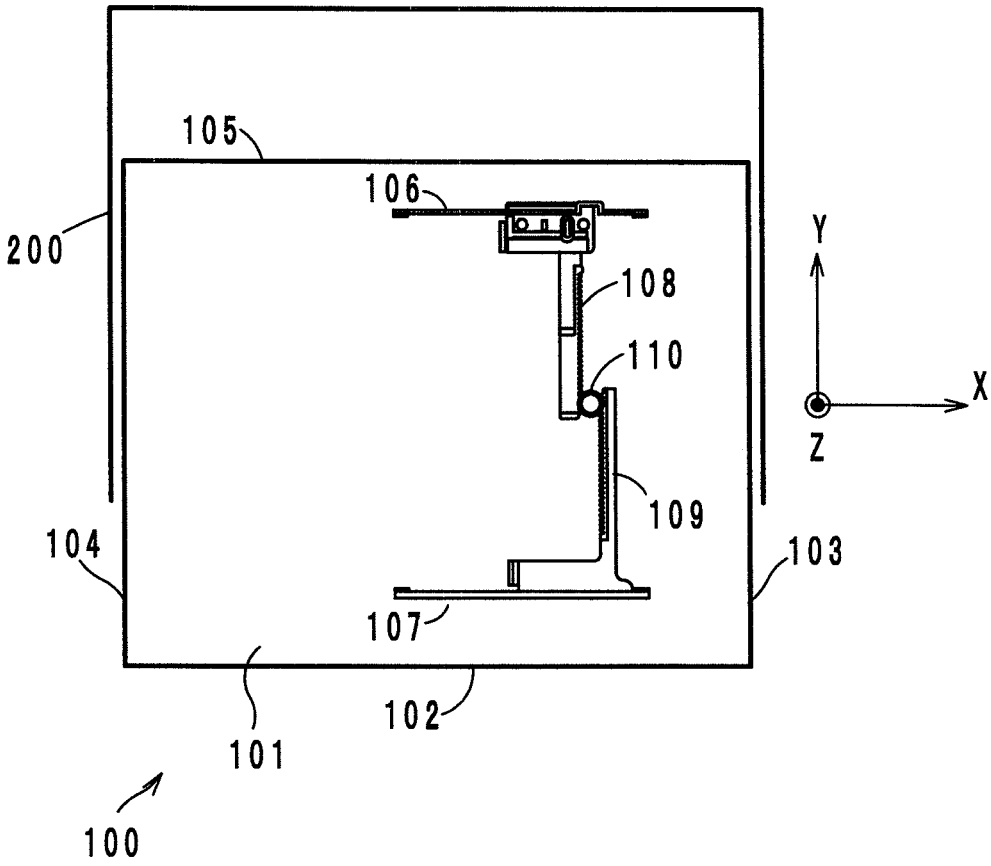
FIG. 9 is a top view of a main part of the conventional sheet feeder cassette.
Figure 10A:
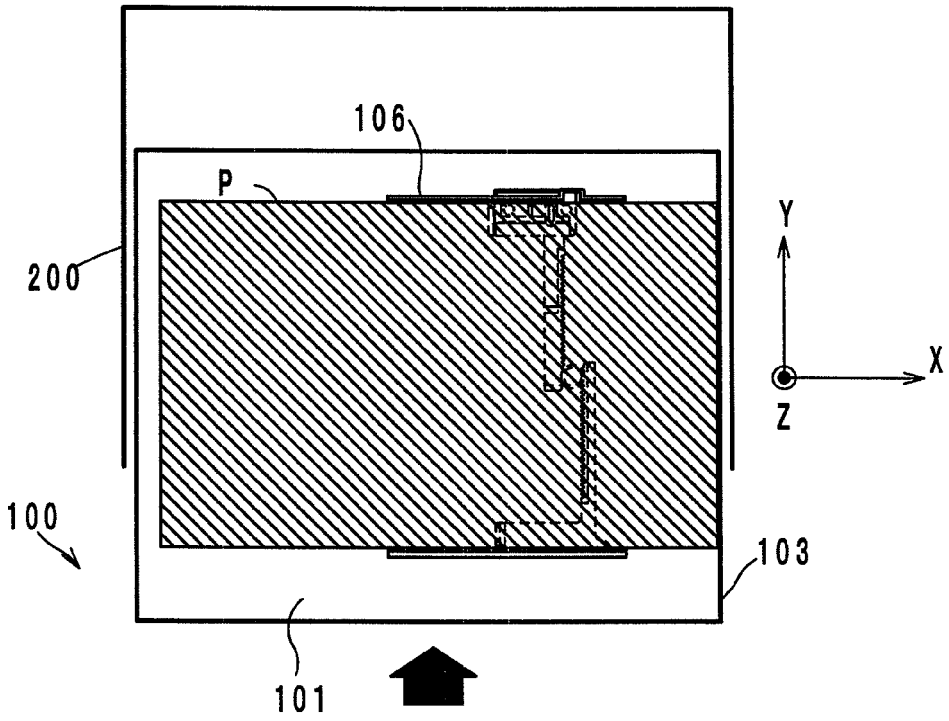
FIG. 10a PRIOR ART
FIGS. 10*a* and 10*b* are illustrations showing a problem in the conventional sheet feeder cassette.
Figure 10B:
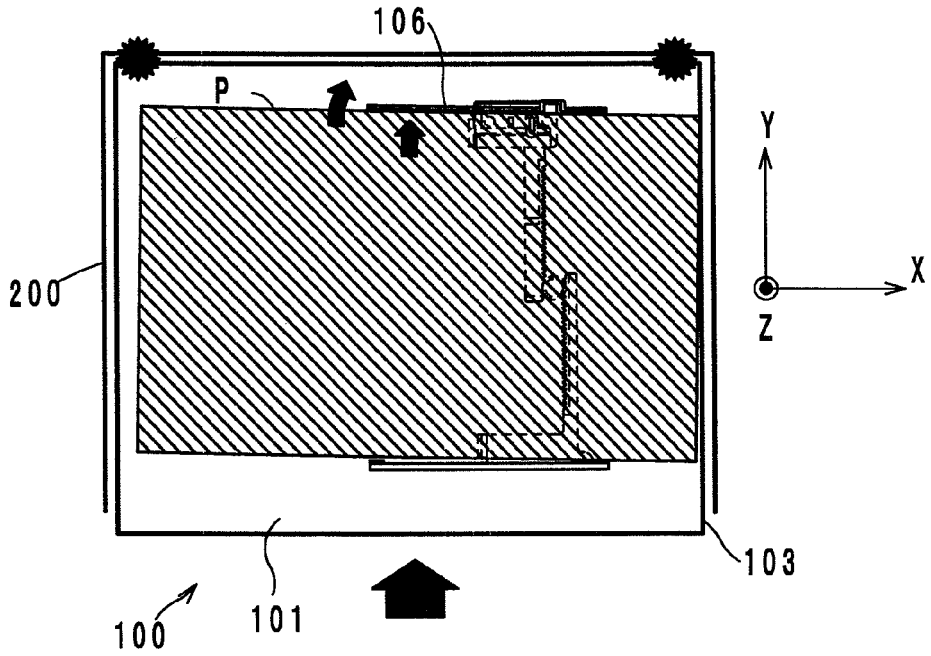
FIG. 10b PRIOR ART

In placing a stack of sheets P of the maximum size into the sheet feeder cassette 50, a user first adjusts the positions of the side stopper plates 56 and 57 to the width of the sheets P. In this moment, the rear surface (the surface facing the rear wall 55) of the side stopper plate 56 comes into contact with the abutting surface 515*b* of the displacement preventive device 510. Thereafter, as shown in FIG. 7*a*, the user places the stack of sheets P onto the bottom 51 with one side of the stack of sheets P pressed against the right wall 53. Next, the user pushes the sheet feeder cassette 50 in the fit-in direction to fit the cassette 50 into the sheet feeder unit 30. When the cassette 50 is pushed to the rear end of the sheet feeder unit 30, as shown by FIG. 7*b*, the sheets P try to still keep moving in the placing direction due to inertia force, and the side stopper plate 56 receives the force in the fit-in direction. In the meantime, the displacement preventive device 510 pushes back the upstream end of the side stopper plate 56 due to reaction, which prevents displacement and deformation of the side stopper plate 56.

According to this embodiment of the present invention, the position of the displacement preventive device 510 is adjusted to the maximum sheet size used in a country or region to which the image forming apparatus is to be shipped, for example, at the factory. Thus, the displacement preventive device 510 can be used for image forming apparatuses to be shipped to various countries. Therefore, it is not necessary to prepare different support members and fall preventive members for various countries, which has been conventionally necessary. Hence, according to this embodiment of the present invention, it is possible to provide a sheet feeder cassette 50 having a device for preventing displacement and distortion of the side stopper plate 56 without making any changes for various countries.

According to this embodiment of the present invention, the displacement preventive device 510 is located upstream in the sheet path, and the pivot center (pinion gear 514) of the side stopper plates 56 and 57 is located downstream in the sheet path. Thus, the displacement preventive device 510 is located as far as possible away from the pinion gear 514 and, at the location, supports the side stopper plate 56 from its rear. With this arrangement, it is possible to prevent displacement and deformation of the side stopper plate 56 most effectively.

According to this embodiment of the present invention, also, the left end of the side stopper plate 56 is located leftward from the center in the lengthwise direction of a sheet P of the loadable maximum size. Accordingly, the displacement preventive device 510 supports the side stopper plate 56 at a position leftward from the center of the maximum size sheet P. Thereby, the displacement preventive device 510 can exert the most effective performance of preventing displacement and deformation of the side stopper plate 56.

Other Embodiments

According to the embodiment described above, the displacement preventive device 510 is fixed in a position in accordance with the maximum size sheet P. This is because displacement and deformation of the side stopper plate 56 are likely to occur when sheets P of the maximum size are stacked in the cassette 50. Also, displacement and deformation of the side stopper plate 56 are less likely to occur when sheets P other than the maximum size are stacked in the cassette 50, and therefore, it is not necessary to adjust the position of the displacement preventive device 510 to such sheet sizes. In this regard, however, a user can adjust the position of the displacement preventive device 510 to the size of sheets P currently used, if he/she wants.

In the embodiment above, the displacement preventive device 510 and the slide groove 511 are provided to prevent displacement and deformation of the side stopper plate 56.

This is because displacement and deformation of the side stopper plate 56 are likely to occur when the cassette 50 is fitted into the sheet feeder unit 30. Considering that displacement and deformation of the side stopper plate 57 may occur when the cassette 50 is drawn from the sheet feeder unit 30, another displacement preventive device and another slide groove, which are similar to the displacement preventive device 510 and the slide groove 511 respectively, may be additionally provided to support the side stopper plate 57.

Although the present invention has been described in connection with the preferred embodiment above, it is to be noted that various changes and modifications are possible for those who are skilled in the art. Such changes and modifications are to be understood as being within the scope of the present invention.

What is claimed is:

1. A sheet feeder cassette that can be fitted in and drawn from in a fitted in direction perpendicular to a sheet feeding direction in which sheets of a recording medium are to be fed, the sheet feeder cassette having a front side and rear side with respect to the fitted in direction, the sheet feeder cassette comprising:

a bottom for receiving a stack of sheets of a recording medium thereon;

a pair of side stopper plates that are respectively provided on the front side and the rear side of the location of the stack of sheets on the bottom in such a manner to be movable in a widthwise direction of the stack of sheets so as to determine a widthwise position of the stack of sheets; and at least one displacement preventive device that is located on the bottom, at a position according to a widthwise position of a loadable maximum size sheet, and that is capable of coming into contact with one of the side stopper plates that is located on the rear side of the location of the stack of sheets, the position of the at least one displacement preventive device being continuously adjustable in the widthwise direction from a first position to a second position, wherein when the one of the side stopper plates that is located on the rear side of the location of the stack of sheets receives force from a stack of the maximum size sheets placed on the bottom at a time of fitting in the sheet feeder cassette, the displacement preventive device pushes back and supports the one of the side stopper plates due to reaction, and wherein the pair of side stopper plates has a pivot center that is located relatively downstream with respect to the sheet feeding direction; and the displacement preventive device is located upstream, with respect to the sheet feeding direction, from the pivot center of the pair of side stopper plates.

2. A sheet feeder cassette according to claim 1, wherein:

a slide groove is made in the bottom in such a manner to extend in the widthwise direction of the stack of sheets, and the displacement preventive device slides along the slide groove; and the displacement preventive device is fixed on the slide groove, at a position according to a widthwise position of a loadable maximum size sheet, which varies by country and region.

3. A sheet feeder cassette according to claim 2, wherein the displacement preventive device includes a first displacement preventive member with a base below the groove, a second displacement preventive member with a pressing surface above the groove, and a threaded fastener to clamp the base and pressing surface to the bottom.

4. A sheet feeder cassette according to claim 1, wherein the displacement preventative device is located upstream, with respect to the sheet feeding direction, from a lengthwise center of a stack of sheets of the maximum size placed on the bottom.

5. A sheet feeder cassette according to claim 1, wherein the displacement preventative device is capable of coming into contact with an end of the one of the side stopper plates that is located on the rear side of the stack of sheets.

6. A sheet feeder cassette that can be fitted in and drawn from in a fitted in direction perpendicular to a sheet feeding direction in which sheets of a recording medium are to be fed, the sheet feeder cassette having a front side and rear side with respect to the fitted in direction, the sheet feeder cassette comprising:

a bottom for receiving a stack of sheets of a recording medium thereon;

a pair of side stopper plates that are respectively provided on the front side and the rear side of the location of the stack of sheets on the bottom in such a manner to be movable in a widthwise direction of the stack of sheets so as to determine a widthwise position of the stack of sheets; and at least one displacement preventive device that is located on the bottom, at a position according to a widthwise position of a loadable maximum size sheet, and that is capable of coming into contact with one of the side stopper plates that is located on the rear side of the location of the stack of sheets, the position of the at least one displacement preventive device being continuously adjustable in the widthwise direction from a first position to a second position, wherein when the one of the side stopper plates that is located on the rear side of the location of the stack of sheets receives force from a stack of the maximum size sheets placed on the bottom at a time of fitting in the sheet feeder cassette, the displacement preventive device pushes back and supports the one of the side stopper plates due to reaction, and wherein the displacement preventive device is located upstream, with respect to the sheet feeding direction, from a lengthwise center of a stack of sheets of the maximum size placed on the bottom.

7. A sheet feeder cassette that can be fitted in and drawn from in a fitted in direction perpendicular to a sheet feeding direction in which sheets of a recording medium are to be fed, the sheet feeder cassette having a front side and rear side with respect to the fitted in direction, the sheet feeder cassette comprising:

a bottom for receiving a stack of sheets of a recording medium thereon;

a pair of side stopper plates that are respectively provided on the front side and the rear side of the location of the stack of sheets on the bottom in such a manner to be movable in a widthwise direction of the stack of sheets so as to determine a widthwise position of the stack of sheets; and at least one displacement preventive device that is located on the bottom, at a position according to a widthwise position of a loadable maximum size sheet, and that is capable of coming into contact with one of the side stopper plates that is located on the rear side of the location of the stack of sheets, wherein when the one of the side stopper plates that is located on the rear side of the location of the stack of sheets receives force from a stack of the maximum size sheets placed on the bottom at a time of fitting in the sheet feeder cassette, the displacement preventive device pushes back and supports the one of the side stopper plates due to reaction, and wherein the pair of side stopper plates has a pivot center that is located relatively downstream with respect to the sheet feeding direction; and the displacement preventive device is located upstream, with respect to the sheet feeding direction, from the pivot center of the pair of side stopper plates, wherein a slide groove is made in the bottom in such a manner to extend in the widthwise direction of the stack of sheets, and the displacement preventive device slides along the slide groove; and the displacement preventive device is fixed on the slide groove, at a position according to a widthwise position of a loadable maximum size sheet, which varies by country and region.

8. A sheet feeder cassette according to claim 7, wherein the displacement preventive device includes a first displacement preventive member with a base below the groove, a second displacement preventive member with a pressing surface above the groove, and a threaded fastener to clamp the base and pressing surface to the bottom.

* * * * *